United States Patent [19]

Nishida et al.

[11] Patent Number: 4,488,529

[45] Date of Patent: Dec. 18, 1984

[54] AUTOMOBILE AIR/FUEL CONTROL SYSTEM

[75] Inventors: Toshiaki Nishida; Kazuyuki Okazaki; Hideki Kakumoto; Tatsuji Ikeda, all of Hiroshima, Japan

[73] Assignee: Mazda Motor Corporation, Shinchi, Japan

[21] Appl. No.: 554,450

[22] Filed: Nov. 22, 1983

[30] Foreign Application Priority Data

Nov. 24, 1982 [JP] Japan ..... 57-206583

[51] Int. Cl.[3] ..... F02M 7/00

[52] U.S. Cl. ..... 123/438; 123/436; 123/440; 123/489; 123/492

[58] Field of Search ..... 123/438, 436, 437, 440, 123/489, 492

[56] References Cited

U.S. PATENT DOCUMENTS 4,056,931 11/1977 Hata ..... 123/438
4,221,191 9/1980 Asano et al. ..... 123/492
4,240,389 12/1980 Shimazaki ..... 123/440
4,329,960 5/1982 Woodhouse et al. ..... 123/436
4,419,975 12/1983 Kubota et al. ..... 123/440

FOREIGN PATENT DOCUMENTS 538427 1/1978 Japan .

*Primary Examiner*—Parshotam S. Lall
*Attorney, Agent, or Firm*—Burns, Doane, Swecker and Mathis

[57] ABSTRACT

An air-fuel ratio control system for an internal combustion engine for controlling the air-fuel mixing ratio of a combustible mixture to be supplied to the engine on a feedback control scheme in dependence on the concentration of a constituent of exhaust gases which is a function of the air-fuel mixing ratio of the combustible mixture having been combusted. The feedback control scheme of the air-fuel ratio control system for adjusting the ratio to the stoichiometric value is temporarily disconnected to permit the mixture to be enriched so that the engine can produce a relatively high power output during the high load engine operating condition.

8 Claims, 5 Drawing Figures

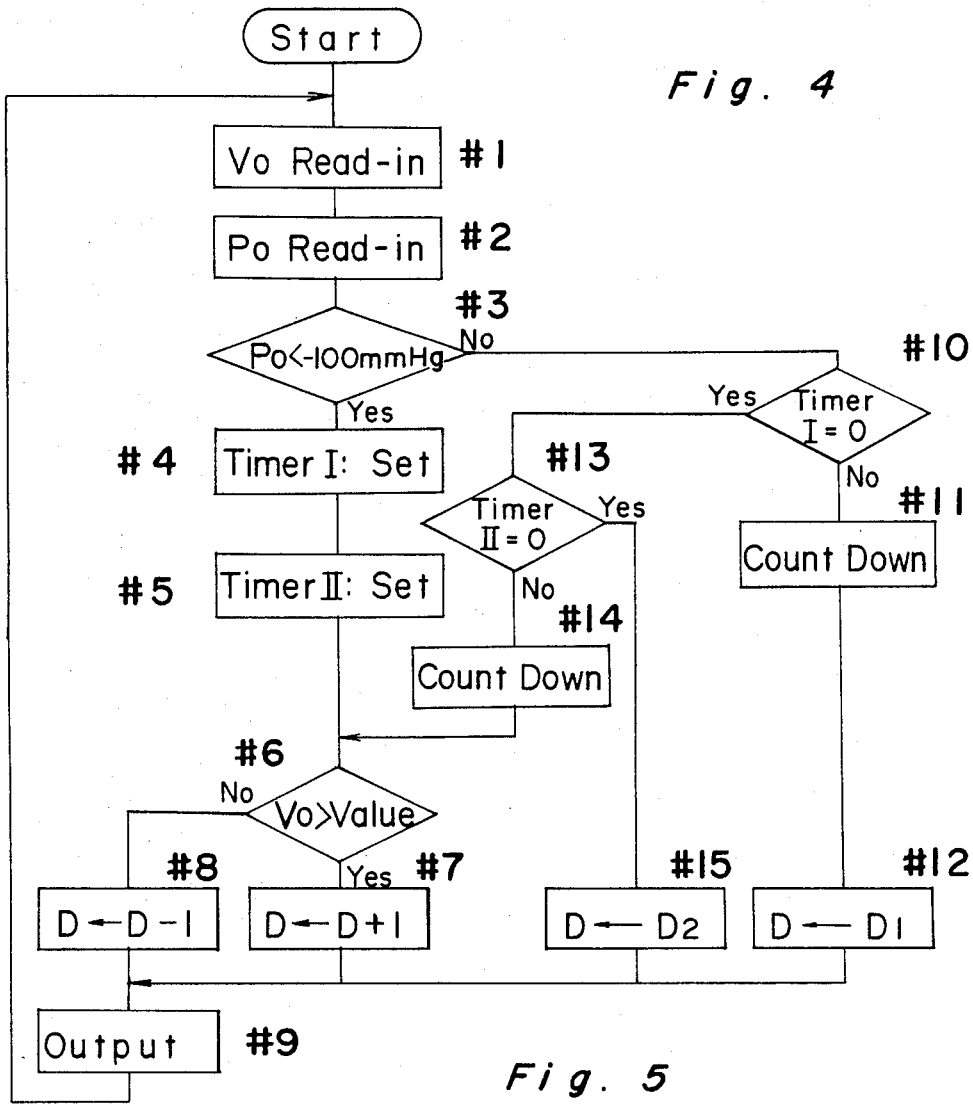
Fig. 4
Fig. 5
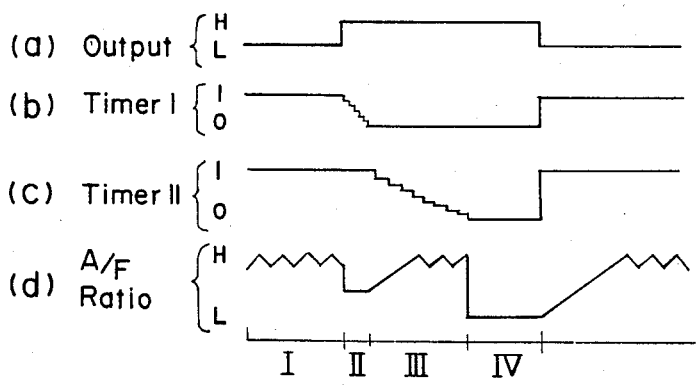

AUTOMOBILE AIR/FUEL CONTROL SYSTEM

BACKGROUND OF THE INVENTION

The present invention relates to an air-fuel ratio control system for an internal combustion engine.

There is well known an air-fuel ratio control system wherein the air-fuel mixing ratio of a combustible mixture to be fed to the engine is controlled to a value approximating to or equal to a stoichiometric value on a feedback scheme in dependence on the concentration of a constituent of the exhaust gases emitted from the engine. In practice, the feedback scheme is enabled only during any one of the medium and low engine operating conditions to render a composition signal, representative of the concentration of the exhaust gas constituent, to be actually used in controlling the air-fuel mixing ratio to the stoichiometric value for the purpose of minimizing the emission of obnoxious components of the exhaust gases.

However, during the high load engine operating condition such as, for example, the acceleration of the engine, the feedback scheme referred to above is disabled to permit the system to control the air-fuel mixing ratio to a lower value than the stoichiometric value. This is because, if the combustible mixture is controlled to have an air-fuel mixing ratio approximating to or equal to the stoichiometric value even during the high load engine operating condition in which a relatively high engine power output is required, the engine will fail to give the high engine power output.

With this type of control system, it has been found that the repeated occurrence of the high load engine operating condition such as often experienced during the city cruising in which acceleration is repeated results in the enriched combustible mixture and, hence, the emission of a relatively great amount of the exhaust gas components to the atmosphere.

The Japanese Laid-open patent publication No. 53-8427, published Jan. 25, 1978, discloses an air-fuel control system which appears to be effective to substantially eliminate the above described disadvantage. According to this publication, the air-fuel control system is so designed as to disable the feedback scheme in the event that air is sucked into the engine at a rate higher than a predetermined value for a length of time greater than a predetermined value. In other words, the control system according to the above mentioned publication, is so designed that, only when and after the engine operating condition in which the relatively high engine power output is required has lasted for a length of time greater than the predetermined value, the combustible mixture to be supplied to the engine is enriched.

However, with the prior art control system such as disclosed in the above mentioned publication, it has been found disadvantageous in that the required engine power output can not be obtained at the time of start of the acceleration with an accelerator pedal fully depressed and, therefore, the acceleration feeling will be adversely affected.

SUMMARY OF THE INVENTION

Accordingly, the present invention has been developed with a view to substantially eliminating the disadvantages and inconveniences inherent in the prior art control systems and has for its essential object to provide an improved air-fuel ratio control system for an internal combustion engine, which is effective to give both the required acceleration feeling and the required output feeling and, at the same time, to minimize the emission of obnoxious components of the exhaust gases.

According to one preferred embodiment of the present invention, the air-fuel ratio control system comprises a mixture supply device for supplying a combustible mixture of air and fuel to the engine, an air-fuel ratio adjusting device for adjusting the air-fuel mixing ratio of the combustible mixture, a detector for detecting a high load engine operating condition, and a control device for applying a first enriching signal to the mixture supply device for decreasing the air-fuel ratio when and at the same time as the detector has detected a transit of the engine operating condition to a high load engine operating condition and for interrupting the generation of the first enriching signal for a predetermined period of time subsequent to the generation of the first enriching signal while applying a second enriching signal to the mixture supply device subsequent to the lapse of the predetermined period of time to decrease the air-fuel mixing ratio.

BRIEF DESCRIPTION OF THE DRAWINGS

These and other objects and features of the present invention will become readily understood from the following description taken in conjunction with preferred embodiments with reference to the accompanying drawings, in which:

FIG. 4 is a flow chart showing the sequence of operation of a microcomputer; and FIG. 5 is a chart similar to FIG. 3, but for the explanation of the sequence of operation in the embodiment of FIG. 4.

DETAILED DESCRIPTION OF THE EMBODIMENTS

Figure 1:
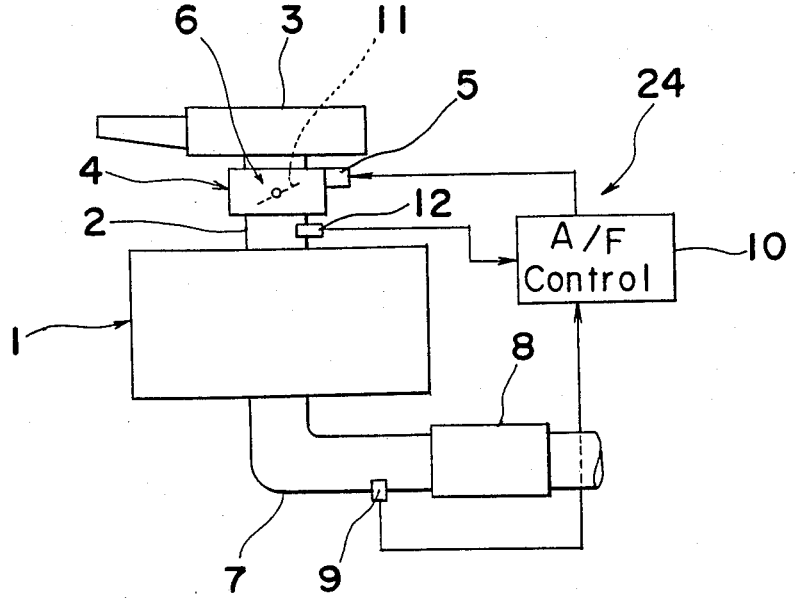
FIG. 1 is a schematic diagram showing an automobile power plant including an air-fuel ratio control system according to the present invention.

Before the description of the present invention proceeds, it is to be noted that like parts are designated by like reference numerals throughout the accompanying drawings.

Referring first to FIG. 1, an automobile power plant shown therein comprises an internal combustion engine 1 having its fuel intake passage 2 and an exhaust passage 7. The fuel intake passage 2 is communicated to the atmosphere for the introduction of air into the engine through an air filter 3 and a carburetor 4. The carburetor 4 has an air bleed port adapted to be adjustably closed and opened by an solenoid actuator 5 according to a duty ratio for adjusting the air-fuel mixing ratio of a combustible mixture to be supplied from the carburetor 4 towards the engine 1. The carburetor 4 and the solenoid actuator 5 together constitute a mixture supply device 6.

On the other hand, the exhaust passage 7 for the discharge of exhaust gases from the engine 1 to the atmosphere includes a catalytic converter 8 for minimizing the emission of obnoxious components, such as HC, CO and $NO_x$, contained in the exhaust gases, and also a composition sensor 9 disposed thereon between the engine 1 and the exhaust gas purifier 8 for detecting the concentration of a constituent, for example, oxygen, of the exhaust gases. As is well known to those skilled in the art, the concentration of oxygen in the exhaust gases emitted from the engine 1 is a function of the air-fuel mixing ratio of the combustible mixture which has been supplied to and combusted in the engine 1 and, therefore, an electric output signal, or a composition signal, generated from the composition sensor 9 represents substantially the air-fuel mixing ratio of the combusted mixture. The composition signal from the sensor 9 is supplied to an air-fuel ratio control 10 as will be described later.

The control 10 receives not only the composition signal from the sensor 9, but also a pressure signal generated from a pressure sensor 12 for detecting the negative pressure inside the intake passage 2 at a position downstream of a throttle valve 11 of the carburetor 4. The pressure signal signifies the occurrence of a high load operating condition of the engine 1 and, for this purpose, is generated from the sensor 12 when the negative pressure inside the intake passage 2 and downstream of the throttle valve 11 becomes a value lower than a predetermined negative pressure, for example, −100 mmHg incident to the full opening of the throttle valve 11. In the illustrated embodiment, the mixture supply device 6, the composition sensor 9, the pressure sensor 12 and the control 10 together constitute an air-fuel ratio control unit 24. The control 10 applies to the solenoid actuator 5 its output signal in the form of pulses of the duty ratio determined by the control unit 24 as a while as will be described subsequently.

Figure 2:
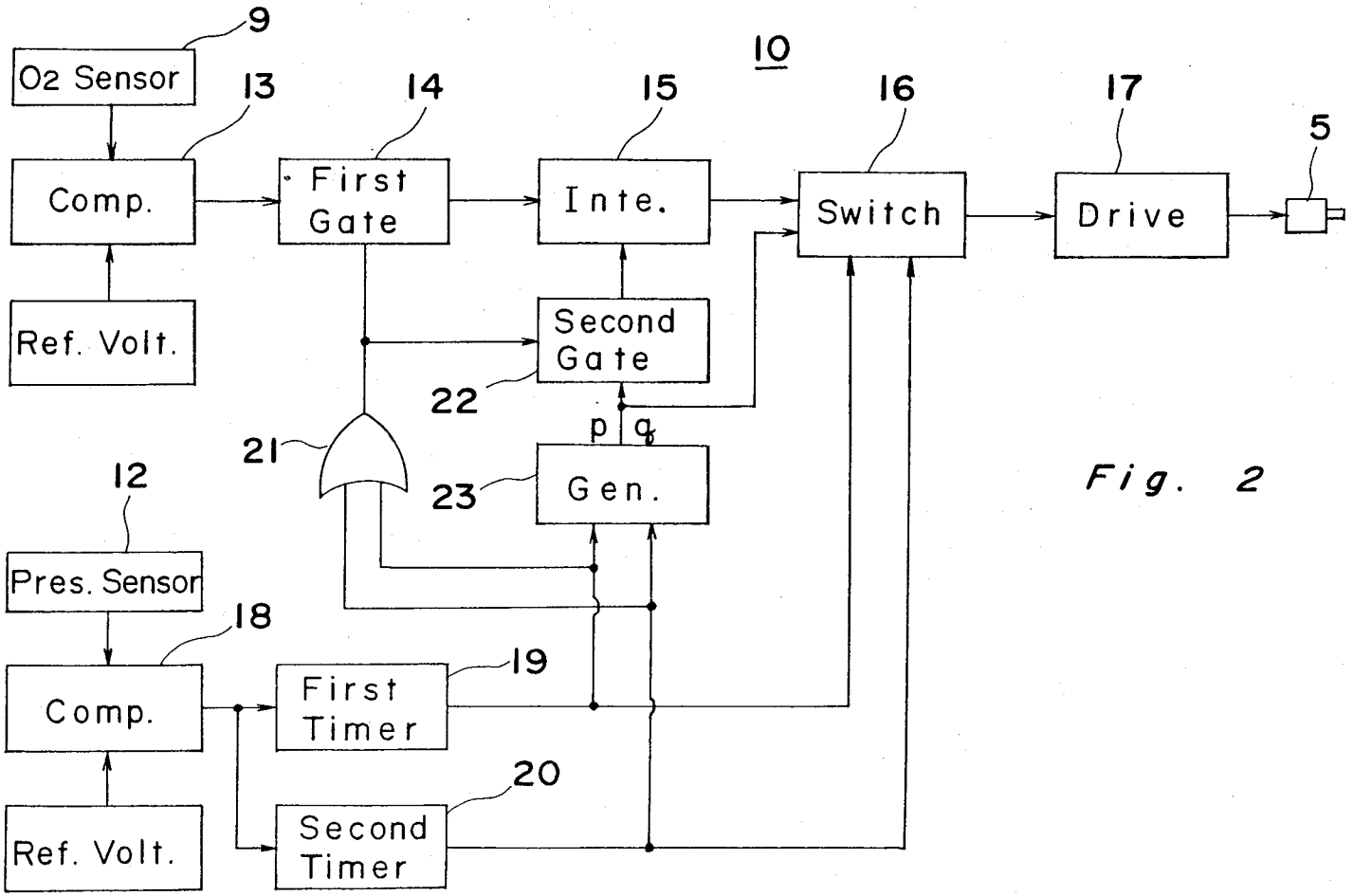
FIG. 2 is a block circuit diagram showing the system shown in FIG. 1.

Referring now to FIG. 2, there is shown the details of the air-fuel ratio control 10. The control 10 basically comprises a feedback loop operable during any one of the medium and low load operating conditions of the engine 1 and an enriching circuit operable during the high load engine operating condition, i.e., when and after the negative pressure inside the intake passage 2 downstream of the throttle valve 11 has attained a value lower than the predetermined negative pressure of −100 mmHg so far shown, while opening the feedback loop. The feedback loop of the air-fuel ratio control 10 includes a comparator 13 for comparing the composition signal from the sensor 9 with a reference signal indicative of a predetermined air-fuel mixing ratio, for example, a stoichiometric air-fuel mixing ratio, to determine whether the combusted mixture had been enriched or leaned relative to the stoichiometric value, a difference output of the comparator 13 being then fed through a first gating circuit 14 to an integrator 15 whereat the difference signal is integrated with respect to time. An integrated output from the integrator 15 is then applied through a switching circuit 16 to a solenoid drive circuit 17 which determines the duty ratio of the solenoid actuator 5 according to the integrated output of the integrator 15 and drives the actuator 5 according to the duty ratio determined thereby to adjust the air-fuel mixing ratio of the combustible mixture to be supplied from the carburetor 4 to the engine 1.

The feedback loop described above is so designed, and operates in such a manner that, in the event that the composition sensor 9 has successively generated the composition signals indicative of the enriched mixture having been combusted in the engine 1, the integrated value represented by the output from the integrator 15 can be increased and, consequently, the duty ratio determined for the actuator 5 can be increased to enable the combustible mixture subsequently supplied to the engine 1 to be leaned and that, in the event of the successive generation from the composition sensor 9 of the composition signals indicative of the leaned mixture having been combusted in the engine 1, the duty ratio can be decreased to enable the combustible mixture subsequently supplied to the engine 1 to be enriched. In this way, the feedback loop when in operation operates so as to adjust the air-fuel mixing ratio of the combustible mixture to the stoichiometric value in dependence on the concentration of the exhaust gas constituent detected by the composition sensor 9, that the duty ratio is adapted to be controlled within the range of around 40 to 60 percent.

Figure 3:
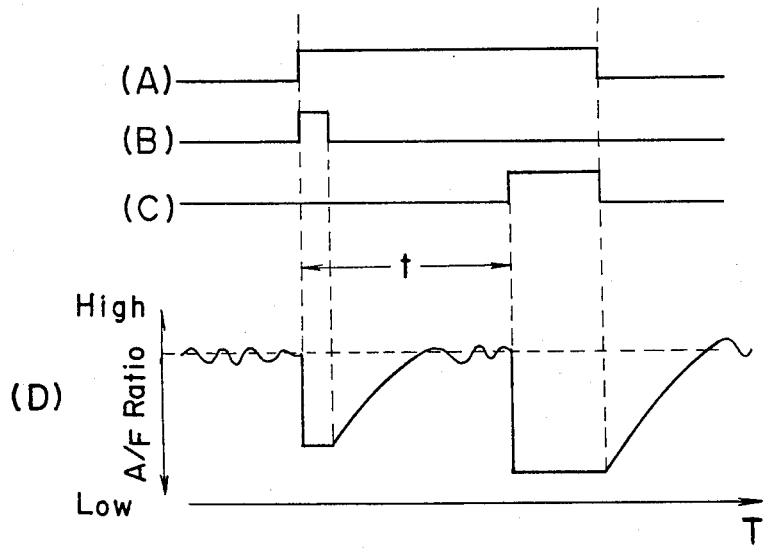
FIG. 3 is a timing chart showing the waveforms of signals appearing in the circuit of FIG. 2.

The enriching circuit, which constitutes the air-fuel ratio control 10 together with the feedback loop, includes a comparator 18 for comparing the pressure signal from the pressure sensor 12 with a reference signal indicative of the predetermined negative pressure, that is, −100 mmHg so far shown, and for generating a difference signal indicative of the occurrence of the high load engine operating condition, as shown by the waveform (A) in FIG. 3, when the negative pressure detected by the sensor 12 has lowered below the predetermined negative pressure. The difference signal (A) is in turn fed to both of the first and second timers 19 and 20.

The first timer 19 has a preset operating time of about 1 second and generates, in response to the difference signal from the comparator 18, a first timer output having a pulse duration equal to the preset operating time of the timer 19 as shown by the waveform (B) in FIG. 3. The first timer output (B) is fed through an OR gate 21 to both of the first and second gating circuits 14 and 22. When the first timer output is applied to the first gating circuit 14, the first gating circuit 14 is disabled to interrupt the transmission of the difference signal from the comparator 13 to the integrator 15, that is, to open the feedback loop. However, when the first timer output (B) is applied to the second gating circuit 22, the latter is enabled to permit a first enriching signal p, generated from an enriching signal generator 23, to be fed to the integrator 15 so that the integrated value of the integrator 15 can be locked at a value corresponding to the first enriching signal p.

The enriching signal generator 23 is so designed as to generate the first and second enriching signals p and q when the first and second timer outputs, shown by (B) and (C) in FIG. 3, are respectively applied thereto from the first and second timers 19 and 20. For the purpose of the illustrated embodiment of the present invention, the enriching signal generator 23 is so designed as to generate the first enriching signal p effective to drive the solenoid actuator 5 at the duty ratio of, for example, 20% in order to assure the required acceleration feeling and also the required output feeling, and the second enriching signal q effective to drive the actuator 5 at the duty ratio of, for example, 0% in order to assure the high engine power output.

Assuming that the enriching signal generator 23 generates the first enriching signal p in response to the first timer signal (B) fed thereto from the first timer 19, the first enriching signal p is applied not only to the integrator 15 through the second gating circuit 22, but also to the switching circuit 16. During the generation of the first timer signal from the first timer 19, the switching circuit 16 is switched in such a state as to receive the signal from the enriching signal generator 23, but not the integrated output from the integrator 15 and, accordingly, the first enriching signal p is then applied through the switching circuit 16 to the drive circuit 17 to drive the actuator 5 at the duty ratio of 20% thereby temporarily enriching the combustible mixture being supplied to the engine.

After the lapse of the preset operating time of the first timer 19, the first timer signal steps down and, consequently, the first and second gating circuits 14 and 22 are enabled and disabled, respectively. At the same time, the switching circuit 16 is brought into another state to permit it to receive the integrated output from the integrator 15, but not the signal from the enriching signal generator 23. In this condition, the feedback loop is completed temporarily. Since the integrated value has been locked by the first enriching signal p, fed to the integrator 15 up until that time, at the value corresponding to the duty ratio of 20%, the feedback control of the air-fuel mixing ratio starts from the integrated value so locked. Because of the above described reason, as shown by (D) in FIG. 3, the air-fuel mixing ratio of the combustible mixture to be supplied to the engine is gradually increased to attain the stoichiometric value according to the time constant of the integrator 15 and is, after a predetermined time during which it has attained the stoichiometric value, then decreased thereby avoiding any possible abrupt change in the air-fuel mixing ratio and, hence, any possible engine shocking.

The second timer 20 connected in parallel to the first timer 19 is so designed as to generate the second timer signal, shown by (C) in FIG. 3, at the timing a predetermined transit time t, for example, 15 seconds, subsequent to the generation of the difference signal (A) from the comparator 18, said predetermined transit time t being selected in consideration of the emission characteristic of the engine 1. The second timer signal (C) from the second timer 20 is applied through the OR gate 21 to both of the first and second gating circuits 14 and 22 and also to both the enriching signal generator 23 and the switching circuit 16. Therefore, when the second timer signal is generated from the second timer 20, the feedback loop is opened again and the second enriching signal q generated from the enriching signal generator 23 in response to the second timer signal (C) is applied to the drive circuit 17 through the switching circuit 16, thereby driving the actuator 5 at the duty ratio of 0%, i.e., to close the air bleed port, to permit the combustible mixture to be enriched so that the engine 1 can produce a relatively high power output required during the high load operating condition.

However, when the engine 1 is brought into or operated under any one of the medium and low load operating conditions, during which the negative pressure inside the intake passage 2 and detected by the pressure sensor 12 is equal to or higher than −100 mmHg, the pressure sensor 12 ceases to generate the pressure signal (A) resulting in the termination of the second timer signal (C) from the timer 20. Upon the termination of the second timer signal from the second timer 20, the first and second gating circuits 14 and 22 are disabled and enabled, respectively, with the air-fuel ratio control on the feedback scheme being consequently re-initiated.

Although not specifically shown in FIG. 3, it is, however, to be noted that, if the accelerator pedal which has been depressed is released during the transit time t to permit the engine 1 then under the acceleration to be operated under any one of the medium and low load operating conditions, the second timer 20 will not generate any second timer signal and, therefore, the air-fuel ratio control on the feedback scheme will continue.

In the case where the accelerator pedal which has been depressed is released after the duty ratio has been fixed at 0% by the use of the second enriching signal q, the engine 1 will be considerably shocked as a result of change in the amount of air being sucked which occurs incident to the release of the accelerator pedal and, therefore, the engine shocking resulting from the re-initiation of the air-fuel ratio control on the feedback scheme can substantially be negligible. In view of this, it is not always necessary to fix the integrated value of the integrator 15 at the value corresponding to the duty ratio of 0%.

Although in the foregoing description the air-fuel ratio has been described as controlled by controlling the duty ratio for the solenoid actuator 5, the present invention may not be limited thereto and may be applicable to any system provided with a mixture supply device effective to and operable to supply the combustible mixture corresponding to the air-fuel ratio characteristic predetermined according to a particular engine operating condition. In addition, instead of the use of the pressure sensor 12, a detector for detecting the opening of the throttle valve or any other known detector may be employed for detecting the occurrence of the high load engine operating condition.

Furthermore, the electric circuit shown in FIG. 2 except for the sensors 9 and 12 and the actuator 5 can be computerized according to another preferred embodiment of the present invention. For this purpose, FIG. 4 illustrates a flow chart showing the sequence of operation of the computer, preferably a microcomputer.

Referring to FIG. 4, after the composition signal Vo from the composition sensor 9 and the pressure signal Po from the pressure sensor 12 have been successively read in the computer at the respective stages #1 and #2, the negative pressure represented by the pressure signal Po is compared with the predetermined negative pressure of −100 mmHg at the step #3 to determine whether or not the engine 1 is operated under a high load operating condition. If the engine has been found to be operated under the high load operating condition, the step #3 is followed by the step #10, but if the engine has been found to be operated under any other operating condition than the high load operating condition, the step #3 is followed by the step #4 at which a timer I for counting the time at which the first enriching signal p (a duty ratio signal $D_1$) is generated is set. At the subsequent step #5, a timer II for counting the time which elapses subsequent to the termination of the first enriching signal p until the second enriching signal q (a duty ratio signal $D_2$) is generated, that is, for counting the time during which the enrichment of the combustible mixture is interrupted, permitting the air-fuel ratio control on the feedback scheme, is set.

Thereafter, and at the step #6, the concentration of the exhaust gas constituent represented by the composition signal Vo is compared with the predetermined value which corresponds to the stoichiometric air-fuel mixing ratio to determine whether or not the combustible mixture combusted in the engine has been enriched. If the result of the decision at the step #6 has indicated the enriched mixture, the decision step is followed by the step #7 at which the duty ratio signal D is synthesized by adding a predetermined value, for example, one, to the previous duty ratio signal D. However, if the result of the decision at the step #6 has indicated the leaned mixture, the step #8 takes place to synthesize the duty ratio signal by subtracting one from the previous duty ratio signal D. Thus, at the steps #6, #7 and #8, the composition signal Vo is integrated to enable the air-fuel ratio control to take place under the feedback control scheme. The duty ratio signal D synthesized at the step #7 or #8 is then applied at the step #9 to the solenoid actuator 5 to control the opening of the air bleed port in the carburetor.

The process including the consecutive steps #4, #5, #6 and #7 or #8 takes place when the engine 1 is operated under any other operating condition than the high load operating condition, and during the execution of this process, the air-fuel mixing ratio of the combustible mixture to be fed to the engine 1 is controlled on the feedback control scheme in dependence on the concentration of the exhaust gas constituent.

On the other hand, if the result of the decision of the step #3 has indicated the engine operating under the high load operating condition, a decision is performed at the step #10 whether or not the timer I is zero. Since the timer I is the one which was set at the step #4 during the air-fuel ratio control on the feedback scheme and is, therefore, not zero at the time soon after the transit to the high load operating condition, the step #10 is followed by the step #11. (See the waveform (a) in FIG. 5.)

At the step #11, and as shown by waveform (b) in FIG. 5, the timer I is counted down. So long as the program flow proceeds through the subsequent step #12, that is, until the timer I becomes zero, the duty ratio signal D is rendered the first enriching signal (Duty ratio:$D_1$), and the step #9 then takes place, thereby enriching the mixture, as shown by the waveform (d) in FIG. 5, during the period II.

However, if the result of the decision at the step #10 has indicated that the timer is, or has become, zero, another decision takes place at the step #13 to determine whether or not the timer II is zero. Since the timer II is zero at the time soon after the step #10 has proceeded to the step #13, the count-down of the timer II takes place at the step #14 as shown by the waveform (c) in FIG. 5. Before the timer II becomes zero, the step #6 follows the step #14 to re-initiate the air-fuel ratio control under the feedback control scheme, as shown by the waveform (d) during the period III.

When the timer II eventually becomes zero, the step #13 is followed by the step #15 at which the duty ratio signal D is rendered the second enriching signal q (Duty ratio:$D_2$), then followed by the step #9, thereby enriching the mixture as shown by the waveform (d) during the period IV in FIG. 5.

From the foregoing full description, it has now become clear that, since the air-fuel ratio control is re-initiated on the feedback control scheme in such a way that the combustible mixture is enriched temporarily at the initial stage of transit from any engine operating condition to the high load operating condition at which time a relatively high power output is required to the engine, the driver can advantageously appreciate the acceleration feeling and the output feeling with the minimized emission of the obnoxious exhaust gas components to the atmosphere.

Although the present invention has fully been described in connection with the preferred embodiments with reference to the accompanying drawings, it is to be noted that various changes and modifications are apparent to those skilled in the art. By way of example, although the present invention has been described as applied to the engine system having a carburetor, it can be applicable also to that having a fuel injection system. Accordingly, unless they depart from the scope of the present invention as defined by the appended claims, they are to be construed as included therein.

We claim:

1. An air-fuel ratio control system for an internal combustion engine having an intake passage, and an exhaust passage extending between the engine and the atmosphere for the discharge of exhaust gases emitted from the engine as a result of combustion of a combustible mixture, which system comprises, in combination:
   - a mixture supply device for supplying the combustible mixture towards the engine;
   - an air-fuel ratio adjusting device for adjusting the air-fuel mixing ratio of the combustible mixture;
   - means for detecting the occurrence of a high load engine operating condition and providing a detector output indicative thereof; and
   - a control means operable in response to the detector signal to apply an enriching signal to the adjusting device, to control said adjusting device to lower the air-fuel mixing ratio during the high load engine operating condition to a value lower than that during a medium load engine operating condition, and also to interrupt the generation of the enriching signal for a predetermined time subsequent to the generation of the enriching signal incident to the transit to the high load engine operating condition.

2. A system as claimed in claim 1, further comprising a catalyst disposed in the exhaust passage, the air-fuel mixing ratio of the combustible mixture to be supplied during the medium load engine operating condition being controlled to a substantially constant value appropriate for the catalyst to perform its purifying function.

3. A system as claimed in claim 2, further comprising a composition sensor for detecting the concentration of an exhaust gas constituent, said air-fuel mixing ratio of the mixture to be supplied during the medium load engine operating condition being controlled to a substantially stoichiometric value on the basis of an output from the composition sensor.

4. A system as claimed in claim 1, wherein the combustible mixture is, during the predetermined time in which the generation of the enriching signal is interrupted, controlled to be of an air-fuel mixing ratio substantially equal to that of the combustible mixture to be supplied during the medium load engine operating condition.

5. An air-fuel ratio control system for an internal combustion engine having an intake passage, and an exhaust passage extending between the engine and the atmosphere for the discharge of exhaust gases emitted from the engine as a result of combustion of a combustible mixture, which system comprises, in combination:
   - a mixture supply device for supplying the combustible mixture towards the engine;
   - an air-fuel ratio adjusting device for adjusting the air-fuel mixing ratio of the combustible mixture;
   - a composition sensor for detecting the concentration of an exhaust gas constituent and generating a composition signal indicative thereof;
   - means for detecting the occurrence of a high load engine operating condition and providing a detector output indicative thereof; and a control means operable in response to the detector signal to apply an enriching signal to the adjusting device to control said adjusting device on a feedback control scheme to render the air-fuel mixing ratio of the mixture to be supplied during a medium load engine operating condition to be of a value substantially equal to the stoichiometric mixing ratio in dependence on the composition signal, and also to control the adjusting device, simultaneously with the transit of the engine operating condition to the high load operating condition, to release the feedback control scheme temporarily and to generate an enriching signal to the adjusting device to decrease the air-fuel mixing ratio to a value lower than the stoichiometric value, said control means being further operable to control for a predetermined time, the adjusting device on the feedback control scheme in dependence on the composition signal subsequent to the temporary release of the feedback control scheme and the generation of the enriching signal and to control the adjusting device in such a way as to apply the enriching signal to the adjusting device by releasing the feedback control scheme during a period subsequent to the lapse of said predetermined time and up until the high load engine operating condition terminates, thereby to make the air-fuel mixing ratio to be lower than the stoichiometric value.

6. An air-fuel ratio control system for an internal combustion engine having an intake passage and an exhaust passage extending between the engine and the atmosphere for the discharge of exhaust gases emitted from the engine as a result of combustion of a combustible mixture, which system comprises, in combination:

a mixture supply device for supplying the combustible mixture corresponding to an air-fuel ratio characteristic predetermined for an engine operating condition;

an air-fuel ratio detector disposed in the exhaust system for detecting the mixing ratio of the mixture;

a high load detector for detecting the occurrence of a high load operating condition of the engine; and a control device operable to control the mixture supply device by feeding back an air-fuel ratio control signal corresponding to a detected value from the ratio detector, said control device being also operable to generate, in response to an output from the high load detector, a first enriching signal for enriching the mixture to the mixture supply device simultaneously with the transit of the engine to a high load operating condition, to interrupt the generation of the first enriching signal for a predetermined time subsequent to the generation of the first enriching signal, and to generate a second enriching signal for enriching the mixture to the mixture supply device after the lapse of said predetermined time.

7. A system as claimed in claim 6, wherein said second enriching signal is a signal necessary to enrich the mixture more than that enriched by the first enriching signal.

8. A system as claimed in claim 5, wherein subsequent to the temporary release of the feedback control scheme and the generation of the enriching signal, the adjusting device is controlled on a feedback control scheme for a predetermined time in dependence on an output from the composition sensor, the air-fuel mixing ratio being gradually controlled to the stoichiometric value within said predetermined time.

* * * * *